United States Patent [19]

Krueger et al.

[11] Patent Number: 4,479,428

[45] Date of Patent: Oct. 30, 1984

[54] STATIC DROPLESS FLAKE ALIGNER FOR PRODUCING COMPOSITE WOOD MATERIAL

[75] Inventors: Gordon P. Krueger, Hancock; Anders E. Lund; Roy D. Adams, both of Houghton, all of Mich.

[73] Assignee: Board of Control of Michigan Technological University, Houghton, Mich.

[21] Appl. No.: 365,169

[22] Filed: Apr. 5, 1982

[51] Int. Cl.[3] ..... B30B 3/02

[52] U.S. Cl. ..... 100/210; 414/300; 198/382

[58] Field of Search ..... 198/535, 445, 446, 631, 198/586, 380, 533, 382; 414/272, 98; 425/253, 255, 258, 83.1; 220/93; 100/210

[56] References Cited

U.S. PATENT DOCUMENTS 3,478,861 11/1969 Elmendorf .
3,721,329 3/1973 Turner et al. .
3,767,065 10/1973 Hall et al. ..... 414/98 X
4,308,227 12/1981 Ufermann ..... 425/83.1 X
4,371,305 2/1983 Pannell ..... 414/272 X
4,380,285 4/1983 Burkner et al. ..... 198/533

*Primary Examiner*—Joseph E. Valenza
*Assistant Examiner*—Dennis J. Williamson

[57] ABSTRACT

Apparatus are provided for forming a loosely felted mat of elongated wood flakes, the wood flakes being supported on an elongated caul. The flakes are deposited between a plurality of closely spaced parallel baffles so as to be aligned in mutually parallel relation. The caul is supported adjacent the lower edges of the baffles and is support for vertical movement to facilitate buildup of the mat. Apparatus movable back and forth along the length of the caul is provided to deposit wood flakes in an evenly dispursed manner. At least one picker wheel also moves along the length of the baffles, the picker wheel including fingers extending downwardly between baffles and adapted to engage the flakes to cause them to fall between the baffles.

5 Claims, 5 Drawing Figures

STATIC DROPLESS FLAKE ALIGNER FOR PRODUCING COMPOSITE WOOD MATERIAL

FIELD OF THE INVENTION

The invention relates to the construction of products from compressed wood particles and, more particularly to apparatus for use in forming a loosely felted mat of wood flakes, the mat being intended to be compressed in a press and to form a densified compressed wood particle product.

BACKGROUND PRIOR ART

As set forth in the Lund et al. U.S. Pat. No. 4,241,133, issued Dec. 23, 1980 and assigned to the assignee of the present invention, it has been found to be desirable in the construction of compressed or composite wood particle products to employ wood flakes which are very thin and which have a length at least several times their width and to align the wood flakes in mutually parallel alignment and in alignment with the longitudinal axis of the product being produced. This produces a product having substantially improved strength characteristics in the direction of alignment of the wood flakes. The production of such compressed wood products requires the formation of a loosely felted mat of wood particles. The mat is then compressed to form the densified product. One problem encountered in forming the loosely felted mat is that the alignment or orientation of the elongated wood flakes is made difficult because the wood flakes, which are very light and comparatively fragile, have to be handled en masse, and this has resulted in the clogging of the known machines that were tried for this purpose. Another problem in connection with handling and orienting the wood flakes has been that the flakes tend to become randomly oriented as they fall onto the mat and must be held in alignment as they are deposited.

Examples of prior art attempts to design suitable apparatus for forming mats of aligned wood strands are set forth in the Urmanov U.S. Pat. No. 3,963,400, issued June 15, 1976; the Turner U.S. Pat. No. 3,721,329, issued Mar. 20, 1973; the Elmendorf U.S. Pat. No. 3,202,743, issued Aug. 24, 1965; the Elmendorf U.S. Pat. No. 3,478,861, issued Nov. 18, 1969; and Canadian Patent No. 597,941, issued May 10, 1960.

Attention is also directed to the Axer et al. U.S. Pat. No. 3,824,058; the Paerels et al. U.S. Pat. No. 3,372,217; the Carlsson et al. U.S. Pat. No. 3,692,612; and the Saidel U.S. Pat. No. 3,867,887. Attention is also directed to the Hostettler U.S. Pat. No. 3,278,764; and the Hostettler U.S. Pat. No. 3,070,838.

SUMMARY OF THE INVENTION

The invention includes apparatus for forming a loosely felted mat of wood flakes mixed with a binder, the loosely felted mat being adapted to be compressed to form a high density composite wood product of unexpected strength as described in the U.S. Lund et al. patent referred to above. The apparatus of the present invention is particularly adapted to cause the wood flakes being deposited and forming the loosely felted mat to be aligned in mutually parallel relation, with substantially all of the flakes being aligned such that they are in nearly parallel relation and substantially parallel to the longitudinal axis of the mat being formed.

More particularly, the invention includes an apparatus for making a loosely felted mat of elongated wood flakes wherein the wood flakes are deposited with the axes of the wood flakes aligned in mutually parallel relation. The apparatus includes an elongated horizontal surface for supporting the mat, means for depositing flakes on the surface and for building up a mat of flakes on the surface, and means for causing mutually parallel alignment of the wood flakes as they are deposited. The means for causing parallel alignment of the wood flakes includes a plurality of elongated thin planar baffles, each defining vertical planes and being disposed in spaced parallel relation. The baffles each have a lower edge positioned adjacent the supporting surface and an upper edge adjacent the means for depositing. Means are also provided for causing wood flakes falling across the upper edges of the baffles to move into substantially parallel alignment with the baffles. This means includes a picker roll having an elongated shaft and a plurality of fingers extending radially outwardly from the shaft and means for supporting the picker roll above the upper edges of the baffles and for reciprocal movement along the lengths of the upper edges and with at least portions of some of the fingers projecting downwardly between the baffles.

The invention also includes a caul having an elongated horizontal surface for supporting a mat of wood flakes, means for depositing flakes on the surface and for building up a mat of flakes on the surface, and means for causing the wood flakes to assume a mutually parallel alignment as they are deposited. The means for causing parallel alignment of the wood flakes includes a plurality of elongated thin planar baffles, the baffles each defining vertical planes and being disposed in spaced parallel relation, the baffles each having a lower edge positioned adjacent the supporting surface and an upper edge adjacent the means for depositing. Means are also provided for supporting the caul for downward movement as the mat thickness increases.

The invention also includes an elongated horizontal surface for supporting a mat of wood flakes, means for depositing flakes on the elongated surface in uniformly and evenly dispersed relation and for building up a mat of flakes on the surface, and means for causing the wood flakes to assume a mutually parallel alignment as they are deposited. The means for causing parallel alignment of the wood flakes includes a plurality of elongated thin planar baffles each defining vertical planes and being disposed in spaced parallel relation, and each having a lower edge positioned adjacent the supporting surface and an upper edge adjacent the means for depositing. The means for depositing the flakes also includes a frame, means for causing movement of the frame along the length of the supporting surface, and a hopper supported by the frame and adapted to contain a quantity of wood flakes. The means for depositing also includes a first conveyor for conveying wood flakes out of the hopper, the first conveyor including a discharge end, and a second conveyor supported by the frame and including one end adapted to receive wood flakes from the discharge end of the first conveyor and an opposite end positioned over the supporting surface and adapted to deposit wood flakes on the supporting surface.

Various other features and advantages of the invention will be apparent from the following description of a preferred embodiment, from the claims, and from the drawings.

Figure 1:
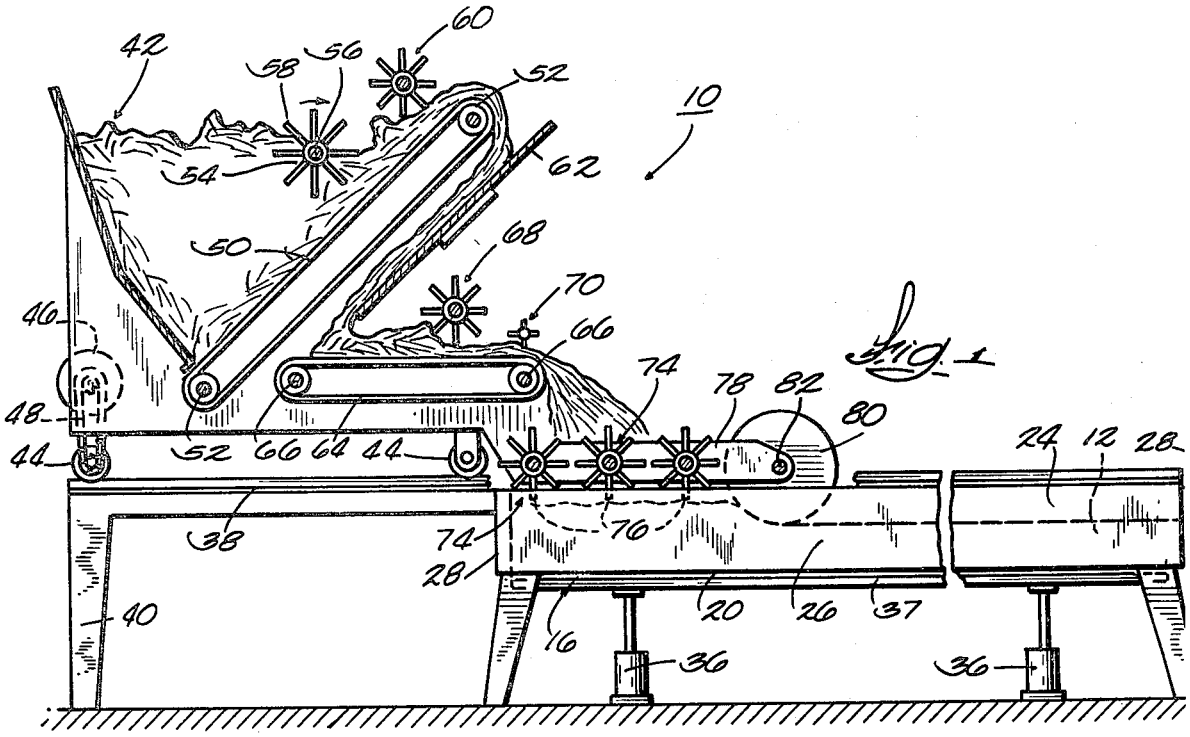
FIG. 1 is an elevation view of apparatus embodying the invention and with portions being broken away.

Before describing a preferred embodiment of the invention in detail, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is an apparatus 10 for use in forming a loosely felted mat 12 of aligned wood flakes 14, the mat 12 being adapted to be compressed in a conventional press (not shown) to form densified or compressed composite wood articles.

As described in the Lund patent referred to above, the composite wood product shown there is formed by first mixing wood flakes with a binder to thereby form a furnish, the wood flakes being elongated and very thin. The loosely felted mat 12 is formed by depositing the wood flakes on a forming surface, the wood flakes being allowed to fall in a loosely felted relation onto the forming surface. The flakes are quite thin and flat, and as they fall, they tend to orient themselves in a horizontal relation and in a stacked interleaved arrangement. As also described in the Lund patent, it has been found that the strength characteristics of structures formed from such composite wood material can be increased if care is taken to select wood flakes having a suitable size and shape and if care is taken to align the wood flakes in substantially mutually parallel orientation and parallel to the axis of the product to be formed.

More particularly, in the preferred form of the invention, such composite wood products can be produced by employing wood flakes which have an average length of about 0.5 inch to about 3.5 inches, preferably about 1.0 inch to about 2.0 inches and an average thickness of about 0.015 to about 0.025 inch and most preferably about 0.02 inch. Flakes longer than about 3.5 inches tend to curl which hinders proper alignment during mat formation and it is difficult to insure that flakes shorter than about 0.5 inch do not become aligned with their grain direction crosswise. Flakes thinner than about 0.01 inch tend to require excessive amounts of binder to obtain adequate bonding, and flakes thicker than about 0.05 inch are relatively stiff and tend to require excessive compression to obtain the desired intimate contact between the flakes during the compression step. In any given batch some of the flakes can be shorter than 0.5 inch and some can be longer than 3.5 inches as long as the average overall length of the flakes is within the above range. Additionally, to facilitate proper alignment, the flakes should have a length which is several times the width, preferably about 4 to about 10 times. Using this constraint as a guide, the average width of the flakes generally should be about 0.1 to about 0.5 inch. It is also preferred that the flakes be formed such that the grain direction of the flakes is generally parallel to the major longitudinal axis thereof. Wood exhibits directional strength properties with the strength of a flake along the grain being greater than across the grain. Accordingly, in order to maximize the strength of the resulting structural member to be formed by the composition of the flakes and the binder material, it is preferred that the flakes have a grain direction parallel to their longitudinal axis.

These flakes are mixed with a binder prior to formation of the loosely felted mat. Suitable binders include those conventional binders used in particleboard or chipboard. In a preferred embodiment of the invention the binder can comprise organic polyisocyanates either alone or in combination with ureaformaldehyde.

Figure 5:
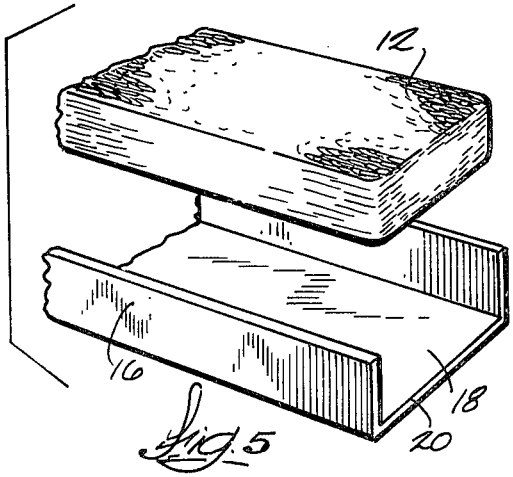
FIG. 5 is an exploded perspective view of portions of the apparatus illustrated in FIG. 1.

Referring again to the apparatus 10 of the invention for forming the loosely felted mat 12, it includes a means for providing a supporting surface for the wood flakes. While this means can have various constructions, in the illustrated arrangement it includes a caul 16, the caul 16 having a supporting surface 18 (FIG. 5) for supporting the flakes, and the caul 16 being housed in a container or box 24 which is open at the top and bottom and which includes side walls 26 and end walls 28 fixedly joined together. As shown more specifically in FIG. 5, the caul 16 includes a rigid flat plate 20 including the upper supporting surface 18 adapted to support the flakes as they are deposited, and the caul 16 having sufficient structural strength to support the loosely felted mat so that the mat can be transferred from the apparatus wherein the mat is formed to a press where the mat is to be compressed. In preferred embodiments, the caul 16 is also adapted to be placed in the press and becomes a press member.

Figure 2:
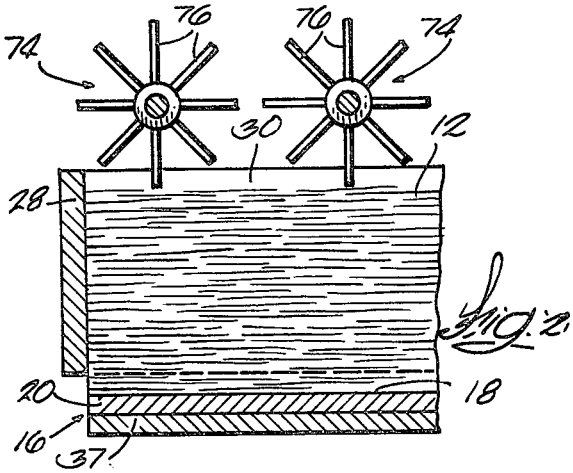
FIG. 2 is an enlarged partial view of the apparatus illustrated in FIG. 1.
Figure 4:
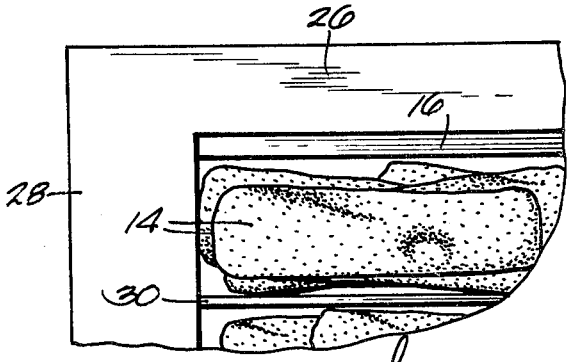
FIG. 4 is a much enlarged partial view of the apparatus illustrated in FIG. 3 and illustrating the flake alignment produced by that apparatus.
Figure 3:
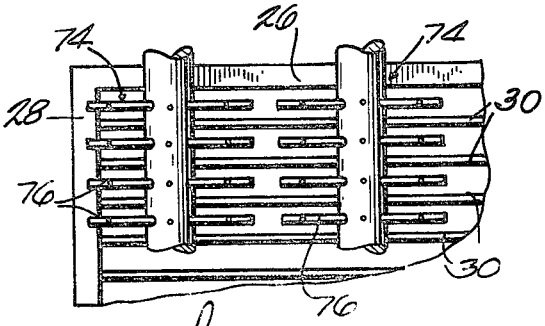
FIG. 3 is a plan view of the apparatus illustrated in FIG. 2.

The apparatus of the invention also provides a means for causing the flakes being deposited on the caul 16 to assume a mutually parallel orientation as they fall onto the supporting surface 18 of the caul and to cause the flakes to remain in that mutually parallel orientation as additional flakes are deposited during build up of the mat 12. In the illustrated construction, the apparatus for causing the flakes to be aligned includes a plurality of spaced apart mutually parallel baffles or plates 30, illustrated in FIGS. 2 through 4, the baffles 30 defining vertical planes parallel to the side walls 26 of the container 24. The parallel baffles 30 are rigidly joined at their opposite ends to the end walls 28 of the container 24. The baffles 30 have a vertical height approximating that of the walls 26 and 28 of the container 24 and include upper edges which are in horizontal alignment with the upper edges of the walls.

Means are also provided for supporting the caul 16 in the container 24 such that the upper supporting surface 18 of the caul 16 can be positioned immediately adjacent the lower edges of the baffles 30. The means for supporting the caul 16 also permits downward vertical movement of the caul 16 with respect to container 24 as the thickness of the mat 12 increases. While various means could be provided for adjusting the vertical position of the caul 16 with respect to the baffles 30 and container 24, in the illustrated arrangement that means comprises a plurality of hydraulic cylinders 36 supporting an elongated horizontal plate 37, the plate 37 in turn supporting the caul 16. As the flakes are deposited in the container 24 and fall between the baffles 30 to form a loosely felted mat on the upper supporting surface 18 of the caul, the caul 16 can be moved downwardly with respect to the container 24 and with respect to the parallel alignment baffles 30 to thereby permit additional flakes to be deposited in the container 24 and to permit a continued build-up of the loosely felted mat.

Means are further provided for depositing layers of wood flakes on the caul 16 in an even distribution along the length of the caul. In the illustrated construction this means comprises an apparatus for traversing the length of the caul in reciprocating relation and means for depositing or laying down flakes in thin layers as the apparatus for depositing the flakes reciprocates. This means for depositing includes a support means comprised of a pair of elongated horizontal tracks 38 supported by legs 40, the tracks 38 being positioned on opposite sides of the container 24 and parallel to its longitudinal axis. In the illustrated arrangement, the tracks 38 are shown as being located closely adjacent the upper surfaces of the container 24 and the vertical baffles 30. It should be understood that in other arrangements the support means could have other configurations.

The means for depositing the flakes further includes a hopper 42 for containing a quantity of the mixture of wood flakes and binder and a means for supporting the hopper 42 for movement along the tracks 38. In the illustrated construction, means for supporting the hopper 42 includes a frame supported on wheels 44, whereby the hopper 42 is adapted to reciprocate along the tracks 38. Drive means are also provided for causing the hopper 42 to move back and forth along the tracks in a reciprocating fashion. While such drive means can have various constructions, in the illustrated arrangement, it includes an electric motor 46 operably connected by a belt 48 and a pulley arrangement to one of the wheels 44 to drive that wheel.

Means are also provided for depositing flakes from the hopper 42 into the container 24 as the hopper moves along the track in reciprocating relation. While the means for depositing can have various constructions, in the illustrated arrangement, it includes a first inclined conveyor 50 having a lower end extending into the hopper 42. The conveyor 50 includes a belt supported at its upper and lower ends by rollers 52, and at least one of the rollers 52 is driven such that flakes are carried by the belt upwardly toward the upper roller 52. Also included is a picker wheel 54 positioned above the conveyor 50 and intermediate its opposite ends, the picker wheel 54 being rotatably driven in a clockwise direction as seen in FIG. 1 and being provided, in part, to break up any large clumps of flakes on the conveyor 50. While the picker wheel 54 can have various constructions, in the illustrated arrangement, it includes a central shaft 56 and a number of radially extending fingers 58 integrally attached to the central shaft 56 and arranged along the length of the shaft 56.

The means for depositing also includes a scalping picker wheel 60 positioned in spaced relation from the conveyor surface and in a position adjacent the upper end of the conveyor 50. The scalping picker wheel 60 has a construction like that of picker wheel 54 and rotates in clockwise direction as seen in FIG. 1. The scalping picker wheel 60 is functional to control the amount of wood flakes carried by the conveyor out of the hopper 42.

In the illustrated construction, the wood flakes move along the conveyor 50 and upwardly so as to be deposited on the upper end of an inclined metal sheet 62. The wood flakes slide down the metal sheet 62 onto a horizontal conveyor belt 64, the horizontal conveyor belt 64 being adapted to move the wood flakes deposited thereon from left to right as seen in FIG. 1. The horizontal conveyor belt 64 is supported at its opposite ends by a pair of rollers 66, at least one of the rollers 66 being rotatably driven by a conventional conveyor drive means.

The illustrated apparatus also includes a scalping picker wheel 68 positioned above the conveyor belt 64 and intermediate its opposite ends. The scalping picker wheel 68 is rotatably driven in a clockwise direction as seen in FIG. 1 and functions to control or limit the quantity of flakes passing over the end of the conveyor belt 64 and discharged into the container 24. Also provided is a distribution picker wheel 70 positioned above the discharge end of the horizontal conveyor belt 64, the distribution picker wheel 70 being adapted to evenly disburse the wood flakes discharged by the conveyor belt 64 onto the caul 16.

In the illustrated arrangement, the apparatus further includes means for traversing the length of the container 24 in a reciprocating manner with the hopper 42 and for causing flakes falling into the container 24 to be aligned parallel with the planes of the vertical baffles 30 and for causing the flakes to drop between the baffles 30. This means includes three picker wheels 74 positioned in parallel side-by-side relation adjacent the upper surface of the container 24. The picker wheels 74 are positioned such that they are rotatable about spaced apart horizontal axes each perpendicular to the longitudinal axis of the container 24 and spaced apart in the longitudinal direction of the container. The picker wheels 74 each include fingers 76 which extend downwardly between the upper edges of the vertical baffle plates 30 such that, in operation, as the three picker wheels 74 move along the length of the container 24, any elongated flakes deposited by the horizontal conveyor belt 64 into the container and which lie across the baffle plates 30 will be contacted by the fingers 76 of the rotating picker wheels 74 and will be caused to align themselves with the baffles 30 whereby these elongated flakes can drop into the cavities between the baffles 30 and accumulate to form the loosely felted mat 12. In the illustrated construction the means for supporting the picker wheels 74 includes an extension 78 of the frame of the hopper 42, the extension 78 being supported for movement with the hopper 42 by the wheels 44.

Means are also provided for precompressing the mat 12 as the wood flakes are deposited, the means for precompressing including a plurality of compression wheels 80 supported in parallel spaced relation on a horizontal shaft 82, respective ones of the compression wheels 80 being supported between the baffles 30. In the illustrated arrangement the horizontal shaft 82 is shown as being supported by the end of the extension 78. In the preferred form of the invention, the compression wheels 80 have a width approximating the distance between the baffles 30, and the compression wheels 80 are freely rotatable on the horizontal shaft 82 such that as the hopper 42 moves along the tracks 38 and flakes are deposited into the container 42, the compression wheels 80 move along the length of the container 24 precompressing the wood flakes to form a mat 12. While the compression wheels 80 function to precompress the mat 12, they also function to apply a downward force on the mat 12 and on the caul 16 tending to push the caul 16 downwardly and tending to push the mat 12 downwardly through the baffles 30.

Once a mat 12 of the desired thickness has been formed, the caul 16 can be removed to a press apparatus where the loosely felted mat can be compressed and form a composite wood product.

Various features of the invention are set forth in the following claims.

We claim:

1. Apparatus for making a loosely felted mat of elongated wood flakes wherein the wood flakes are deposited with the axes of the wood flakes aligned in mutually parallel relation, the apparatus comprising:

means defining an elongated horizontal surface for supporting the mat, means positioned in spaced relation above said horizontal surface and for depositing flakes on said surface and for building up a mat of flakes on said surface, carriage means for supporting said means for depositing for reciprocal movement back and forth along the length of said horizontal surface, means for causing mutually parallel alignment of said wood flakes as said wood flakes are deposited by said means for depositing, said means for causing parallel alignment of said wood flakes including a plurality of elongated thin planar baffles, said baffles each defining vertical planes and being disposed in mutually spaced apart parallel relation, the baffles each having a lower edge positioned adjacent said supporting surface for maintaining parallel alignment of the wood flakes as they are deposited on the elongated horizontal surface and an upper edge adjacent said means for depositing, and means for causing wood flakes falling across said upper edges of said baffles to move into substantially parallel alignment with said baffles, and including a picker roll having an elongated shaft and a plurality of fingers extending radially outwardly from said shaft, said picker roll being supported by said carriage means above said upper edges of said baffles and for reciprocal movement along the lengths of said upper edges and in a direction parallel to the planes of said baffles, and with at least portions of some of said fingers projecting downwardly between said baffles, and means for causing rotation of said picker roll, and means for compressing the flakes deposited by the means for depositing, said means for compressing including a plurality of compression wheels supported in spaced apart parallel relation, and means for supporting said wheels for linear reciprocal movement along the lengths of said baffles with at least portions of said wheels extending downwardly between said baffles and compressing wood flakes supported on said elongated horizontal surface, said wheels being supported by said carriage means with said picker roll and with said means for depositing for reciprocal movement along the lengths of said baffles.

2. An apparatus for making a loosely felted mat as set forth in claim 1 wherein said means defining said supporting surface includes a caul, said caul being elongated and including a longitudinal axis, and further including means for supporting said caul for downward movement as said mat increases in thickness as said flakes are deposited.

3. An apparatus for making a loosely felted mat as set forth in claim 1 wherein said flakes have a length of from 0.5 to 3.0 inches, a thickness of 0.01 to 0.05 inch and a width of 0.1 to 0.5 inch and wherein said baffles are spaced apart by a distance greater than the width of said flakes but by a distance less than the length of said flakes.

4. An apparatus for making a loosely felted mat as set forth in claim 1 and further including a containment box including a pair of end walls and spaced apart elongated vertically extending sidewalls extending between said end walls, and said containment box being open at its top and at its bottom, said baffles being housed in said containment box with opposite ends of said baffles being fixedly supported by said end walls and with said baffles being parallel to said sidewalls.

5. An apparatus for making a loosely felted mat as set forth in claim 1 wherein said means positioned above said surface and for depositing flakes on said surface includes: a hopper adapted to contain wood flakes mixed with a binder, a first conveyor for conveying wood flakes out of said hopper, a first picker wheel positioned above one end of said conveyor and being spaced from said conveyor, a second conveyor having opposite ends, one end adapted to receive wood flakes from said first conveyor and an opposite end positioned over said supporting surface and adapted to deposit wood flakes on said supporting surface, and means for controlling the level of wood flakes on said opposite end of said second conveyor.

* * * * *